US008621675B2

(12) United States Patent
Aspiro

(10) Patent No.: US 8,621,675 B2
(45) Date of Patent: Jan. 7, 2014

(54) PORTABLE AND DISPOSABLE SANITARY TOILET SEAT COVER

(76) Inventor: Stéphanie Aspiro, Anjou (CA)

( * ) Notice: Subject to any disclaimer, the term of this patent is extended or adjusted under 35 U.S.C. 154(b) by 766 days.

(21) Appl. No.: 12/662,786

(22) Filed: May 4, 2010

(65) Prior Publication Data

US 2011/0271433 A1 Nov. 10, 2011

(51) Int. Cl.
*A47K 13/14* (2006.01)

(52) U.S. Cl.
USPC ..... 4/245.1

(58) Field of Classification Search
USPC ..... 4/245.1–245.9
See application file for complete search history.

(56) References Cited

U.S. PATENT DOCUMENTS

| | | | | | |
|---|---|---|---|---|---|
| 190,187 | A * | 5/1877 | Brown | 4/245.9 |
| 1,283,533 | A * | 11/1918 | Leighton | 4/244.3 |
| 3,475,767 | A * | 11/1969 | Friesen et al. | 4/452 |
| 4,589,149 | A | 5/1986 | Bassi | |
| 4,882,794 | A * | 11/1989 | Stewart, III | 4/451 |
| 4,975,990 | A | 12/1990 | Chan | |
| 5,040,249 | A | 8/1991 | Diaz | |
| 5,144,698 | A | 9/1992 | McKenzie | |
| 5,361,424 | A | 11/1994 | Grununfelder et al. | |
| 5,473,789 | A * | 12/1995 | Oster | 15/104.94 |
| 5,537,693 | A | 7/1996 | Dossola et al. | |
| 5,790,989 | A | 8/1998 | Chen | |
| 5,864,892 | A | 2/1999 | Cool | |
| 5,887,291 | A | 3/1999 | Bellizzi | |
| 7,073,212 | B1 * | 7/2006 | Moffat | 4/484 |
| 7,247,360 | B1 | 7/2007 | Besner et al. | |
| 2003/0208836 | A1 * | 11/2003 | Bankemper | 4/245.1 |
| 2006/0288470 | A1 * | 12/2006 | Nnaji | 4/245.2 |

* cited by examiner

*Primary Examiner* — Tuan N Nguyen
*Assistant Examiner* — Erin Deery
(74) *Attorney, Agent, or Firm* — Equinox Protections Inc.; Franz Bonsang

(57) ABSTRACT

A portable and disposable sanitary toilet seat cover comprises an annulus for placement on the toilet seat, the annulus having depending from its inner and outer boundaries inner and outer skirts. A drawstring is reaved into the annulus adjacent the relatively outer boundary thereof and also passes through a perforation at the rear of the cover where there is provided a glove in a stowed condition. When the toilet has been used, actuation of the drawstring collapses the annulus and its skirts and releases the stowed glove. Following full collapse of the cover, a hand is inserted into the glove to grasp the crumpled cover and the glove is then inverted to encase the used toilet seat cover for hygienic disposal.

15 Claims, 5 Drawing Sheets

PORTABLE AND DISPOSABLE SANITARY TOILET SEAT COVER

FIELD OF THE INVENTION

The present invention is related to the field of portable, disposable, sanitary toilet seat covers of the kind that when placed in situ effectively isolate an individual's skin from any contact with the toilet seat, and is easily disposable following use.

BACKGROUND OF THE INVENTION

In this day and age when transmissible infections and diseases are rife, the need for increased hygiene is of paramount importance.

Of course, the use of sanitary disposable toilet seat covers is well known in hospitals and other medical establishments and generally such covers are provided in roll form such as to be easily deployed from a suitable dispenser.

Equally, portable sanitary disposable toilet seat covers are also available, particularly for travelers when prevailing conditions may be less than hygienic and where such covers prove to be at least a primary barrier against contamination through contact with toilet seats.

U.S. Pat. No. 7,247,360 to Besner et al discloses one such sanitary, portable and disposable toilet seat cover with an attached wipe. Although apparently effective in terms of preventing contact between the user's skin and the toilet seat and sides thereof, its simplicity neglects to address the total issue in terms of disposing of the cover after usage. In this respect, it is equally important to ensure continued isolation of an individual's skin from contaminant media and this earlier proposal fails to provide a complete solution to the problem.

Accordingly, there is a need for an improved portable and disposable sanitary toilet seat cover.

SUMMARY OF THE INVENTION

It is therefore a general object of the present invention to provide an improved portable and disposable sanitary toilet seat cover.

An advantage of the present invention is that the cover affords a complete all-embracing hygienic insulation for the individual's skin from the whole of the toilet seat. In this respect, the toilet seat cover of the present invention is so formed as to encompass the totality of the seat form at its inner and outer peripheries.

A further advantage of the present invention is that the cover provides a collapsible feature enabling the cover to be compressed into a relatively small dimension following use, and the cover is typically made out of biodegradable material such as plastic, recycled paper or the like, and preferably pre-sanitized.

A still further advantage of the present invention is that seat cover provides a glove formation integral with the cover and deployable once use of the cover is completed and at the instant of preparation for disposal.

Another advantage of the present invention is that the cover provides an invertible glove to ensure that no contact between the individual's skin and the used seat cover occurs during preparation for disposal and disposal per se.

According to a first aspect of the present invention, there is provided a portable and disposable sanitary toilet seat cover comprising:

- an annulus of a width corresponding to the width of a toilet seat and adapted to provide at least a covering for a top surface of the seat;
- an inner skirt integral with and depending from the annulus on an inner boundary of the annulus;
- an outer skirt integral with and depending from the annulus on an outer boundary of the annulus;
- a glove integral with the annulus; and
- a drawstring provided on the outer boundary of the annulus and adapted, when drawstring ends of the drawstring string are drawn away from the annulus, to inwardly collapse the annulus to sufficiently small dimension for fitting the annulus within a user's hand in the glove to for disposal of the seat cover.

The seat cover of the invention may be of double thickness with the boundaries suitably bonded together either thermally or adhesively. The material from which the seat cover is made may be of medical hygienic standard and may be transparent or opaque.

Both the inner and outer skirts of the annulus are pleated to provide an effective curtain hanging over the inner and outer aspects of the toilet seat. The pleating may conveniently be achieved by forming slits radially extending from the respective inner and outer boundaries of the annulus. Such pleating enables ease of accommodation of differently shaped toilet seats and to ensure adequate coverage over the totality of the toilet seat. The skirts may be flared if so desired.

The annulus is so formed as to provide a looped path for the drawstring, the loops being formed of pairs of short slits, the drawstring being threaded through these loops.

The glove may be of transparent material and is formed with a neck connecting it to the annulus, the neck being suitably perforated in line with the said slits of the looped path whereby the drawstring may also pass therethrough. The glove is initially formed into a rolled, stowed form. The perforation of the neck is conveniently weaker than the slits and accordingly permits rupture upon actuation of the drawstring to enable release of the glove into an unravelled user condition whereby a hand can be inserted therein.

According to a second aspect of the present invention there is provided a method of using the portable and disposable sanitary toilet seat cover of the first aspect, the method comprises the steps of:

- placing the annulus on the top surface of a toilet seat hinged to the top of a toilet bowl;
- deploying the skirts of the annulus such that they depend from the boundaries of the annulus to cover the inner and outer peripheries of the toilet seat and the gap between the seat and the toilet bowl;
- actuating the drawstring following completion of toilet use by the individual, thus both collapsing the annulus with its dependent skirts into a relatively small crumpled mass and deploying the glove; and
- placing a hand in the glove to grasp the crumpled mass of the annulus and the skirts; and inverting the glove whereby the outer surface thereof encases the mass and insulates the wearer's hand from said mass.

The crumpled mass of the annulus and the skirts are thus encased within the now inverted glove to protect the wearer from any contamination.

Other objects and advantages of the present invention will become apparent from a careful reading of the detailed description provided herein, with appropriate reference to the accompanying drawings.

BRIEF DESCRIPTION OF THE DRAWINGS

Other objects and advantages of the present invention will become apparent from a careful reading of the detailed description provided herein, with appropriate reference to the accompanying drawings, in which similar references used in different Figures denote similar components, and wherein.

DETAILED DESCRIPTION OF THE PREFERRED EMBODIMENTS

With reference to the annexed drawings the preferred embodiment of the present invention will be herein described for indicative purpose and by no means as of limitation.

Figure 1:
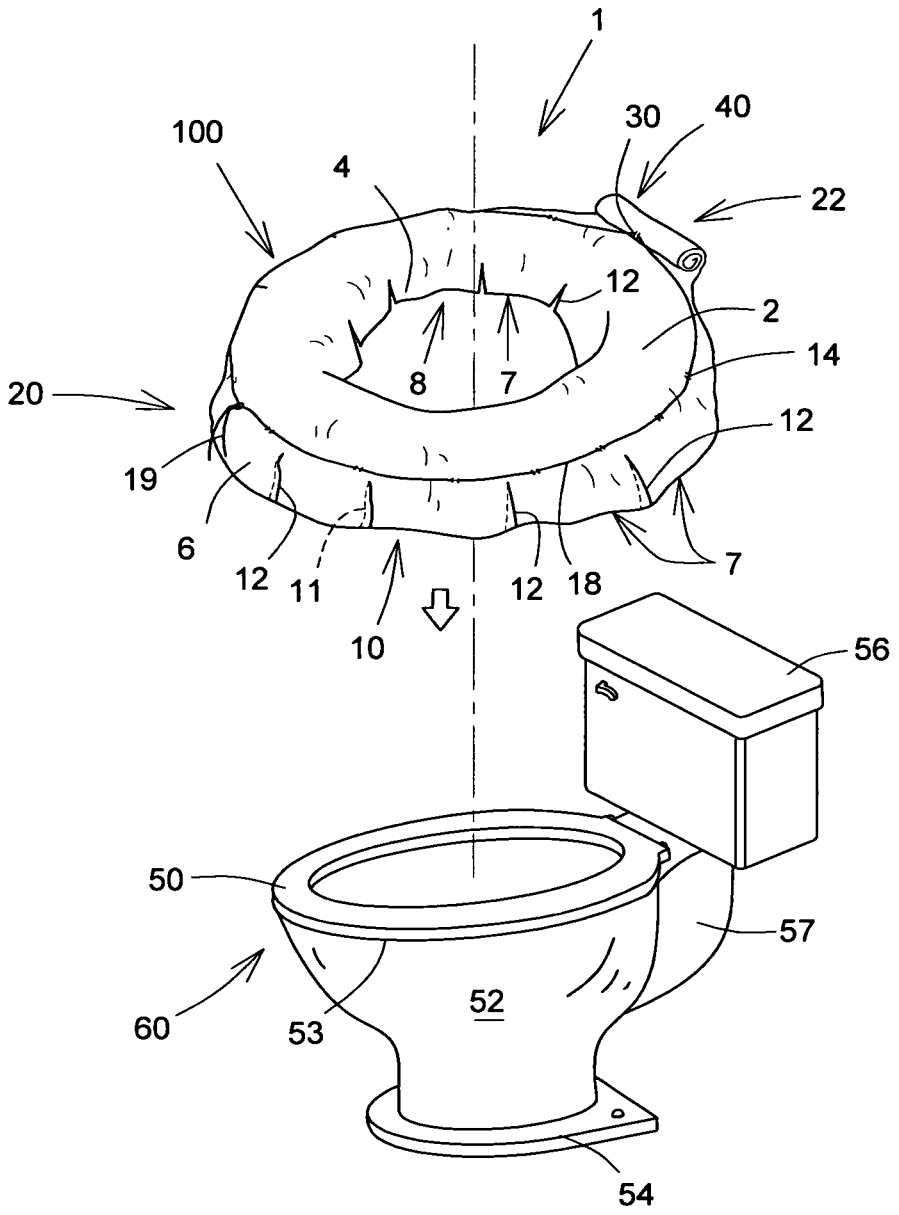
FIG. 1 is a perspective view of the portable and disposable sanitary toilet seat cover in accordance with an embodiment of the present invention arrayed over a toilet for deployment on the toilet seat.
Figure 3:
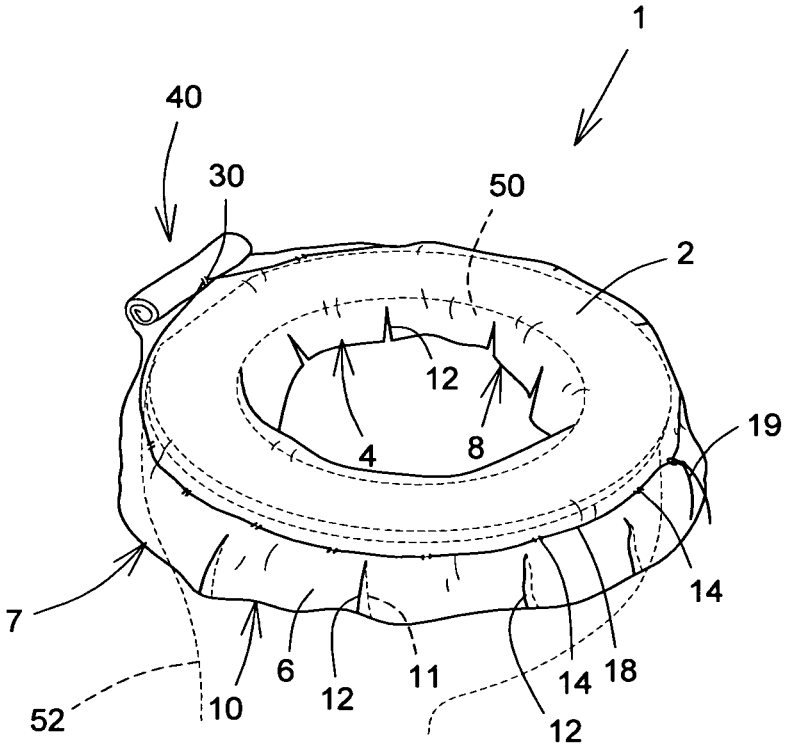
FIG. 3 is a perspective view of the seat cover suitably deployed on the toilet seat.

Now referring to FIGS. 1 and 3, a portable and disposable sanitary toilet seat cover in accordance with an embodiment of the present invention is shown at 1 and comprises an annulus 2 having an inner skirt 4 and an outer skirt 6 formed at and depending from respective inner 8 and outer 10 boundaries thereof. The outer skirt 6 is pleated and flared as at 7, typically along dashed lines 11, preferably by providing spaced apart substantially radial outer pleat slits 12 cut therein as shown, so as to form outer pleats 12 pre-shape the seat cover 1 before it is used (as seen in FIGS. 1 and 3). In an alternative embodiment (not shown) the outer pleat slits 12 are omitted on the outer boundary 10 and the pleats are provided merely by folding or creasing over the material as appropriate, and preferably secured in that folding position. The inner skirt 4 simply has substantially radial inner pleat slits 12 provided therein to form inner pleats 12 and allow the inner boundary 8 to flare downwardly when used.

Adjacent the outer boundary 10 the material from which the seat cover 1 is made is further punctured with relatively smaller pair of substantially radial parallel drawstring retainer slits 14, which form outer loops through which a drawstring 18 is threaded with the ends 19 collected at the front 20 of the cover 1.

Figure 2:
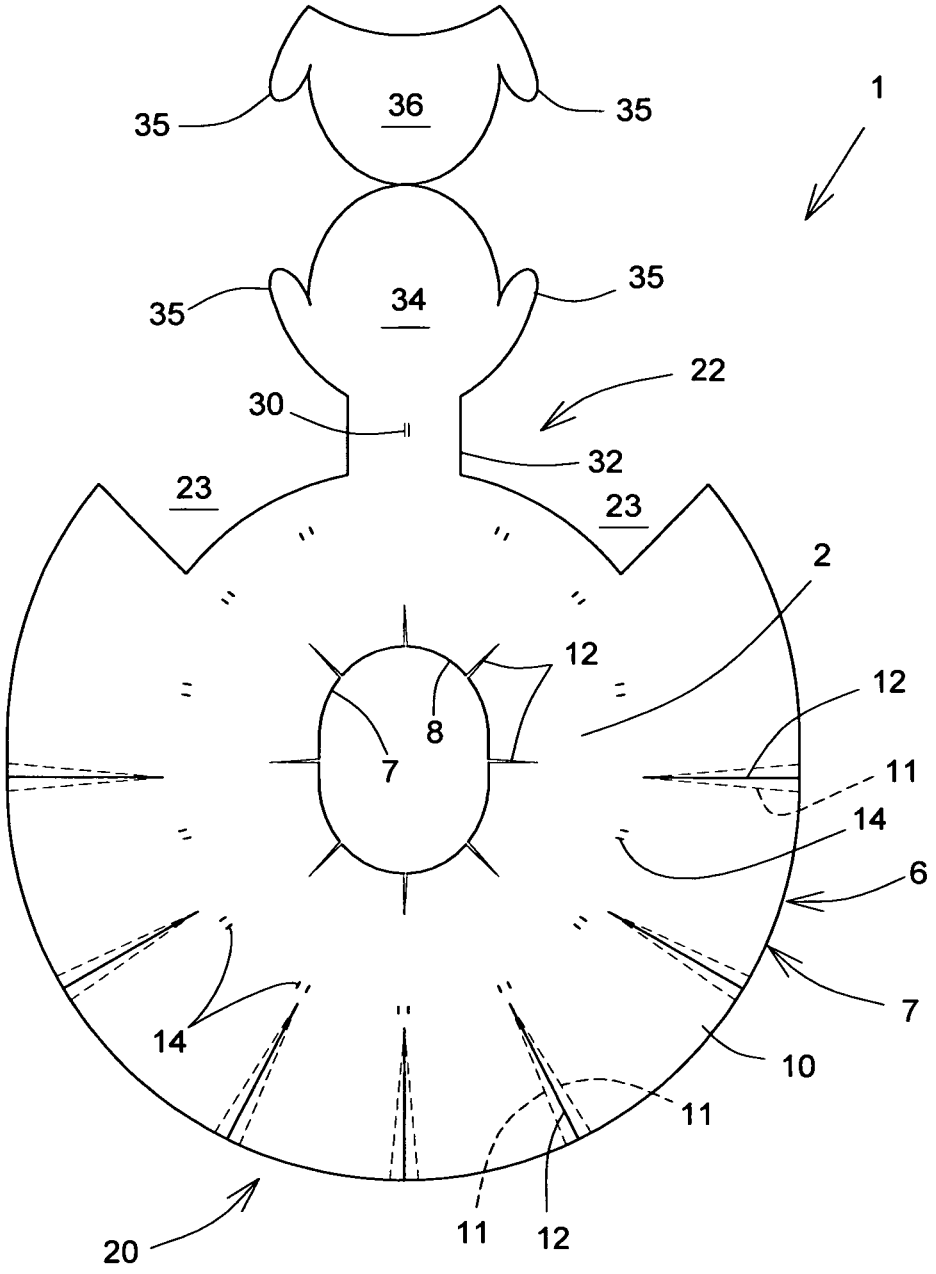
FIG. 2 is a plan view of a blank form of the cover.

At the rear 22 of the seat cover 1 as depicted in FIG. 2 a neck 32 is formed and a perforation 30, also typically formed by a pair of short parallel neck slits, is provided therein through which the drawstring 18 also passes, generally underneath the neck 32, on a lower face which rests on the seat 50 and opposite the upper face upon which the drawstring 18 is disposed on the annulus 2. The perforation 30 is relatively weak (the two slits being close to each other) and is adapted therefore to form a breakable neck loop 30 for rupture upon the application of stress, as shown in FIG. 5. The neck 32 has at its outer portion remote from the annulus 2 a mitten-shaped formation 34 with two thumbs 35 is provided and a mirror image formation 36 is contiguous therewith. During completion of manufacture of the seat cover 1, the formations 34, 36 are folded one on to the other and adhered together at their edges to form a glove 40 for insertion of a hand 49 (FIGS. 4 to 8). The glove 40 may be use either right or left handed and the two thumbs, or thumb portions, 35 are provided for that purpose.

Figure 2A:
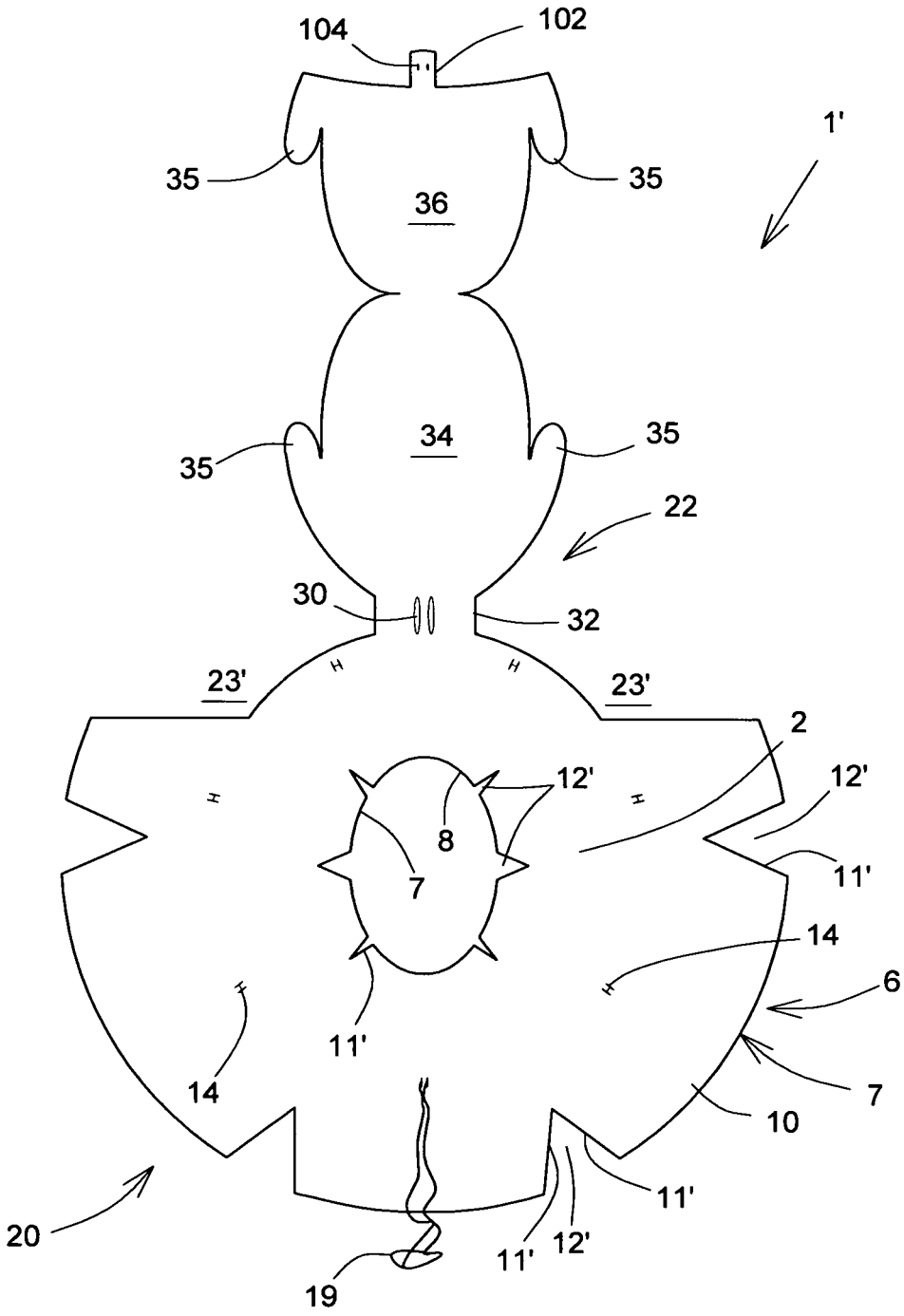
FIG. 2*a* is a plan view of a blank form of a of the cover, in accordance with an alternative embodiment of the present invention.

Referring now to FIG. 2*a*, instead of simple straight slits 12 for cover 1, an alternative embodiment of cover 1' may have outer pleat slits 12' cut along lines 11' that are spaced apart at 10 and which fan inwardly towards, and preferably intersect, one another to provide wedge shaped slits 12'. The inner slits 12' at 8 may be similarly sized and shaped. Further, in addition to neck perforation 30, the mirror image 36 for glove 40 may have a glove tab 102 having tab perforations 104 forming a breakable tab loop 104 disposed thereon, and through which the drawstring 19 may be further threaded, in addition to loop 30. Thus, when drawstring 19 of cover 1' is pulled away from the annulus 2 at front 20, both perforations 30, 104 are severed to release glove 40.

In use, the seat cover 1, 1' is applied to a toilet seat 50 conventionally hinged to the top of a toilet bowl 52 having a base 54 and a cistern 56 for holding and dispensing flush water, these elements comprising a toilet 60. As can be seen from FIG. 1 the cover is opened out to provide the initial configuration 100 shown with the annulus 2 in a substantially flat horizontal orientation with the skirts 4, 6 depending therefrom. In the initial configuration 100, the glove 40 is rolled up at the rear 22 of the cover 1 and effectively held in that stowed position by the drawstring 18 and inner and outer skirts 2, 4 are fully extended for covering the seat 50. The cover is positively located over the seat 50 as seen from FIG. 3 with the ends 19 of the drawstring disposed at the front 20 of the cover 1.

In deploying the seat cover 1, 1' in this way, the whole of the seat 50 is covered including the usual gap (not shown) between the underside of the seat 50 and rim 53 of the bowl 52, both inside and outside. It will be understood that the cover 1, 1' is relieved at the rear 22 as at 23, 23' to accommodate the cistern 56 and conduit 57 leading to the bowl 52.

Figure 4:
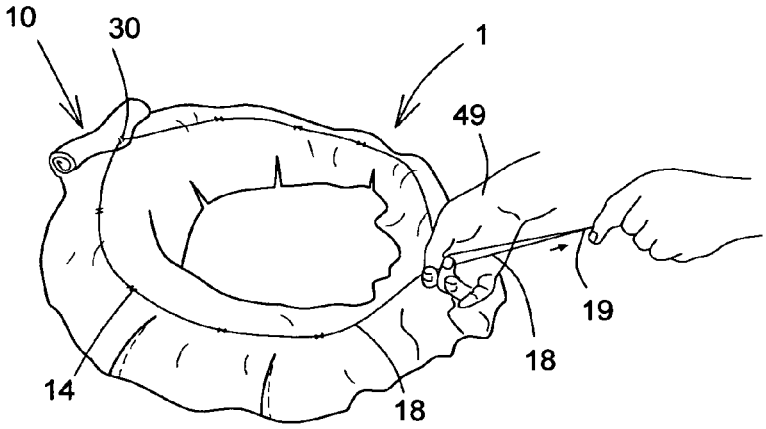
FIGS. 4 and 5 show the actuation of the drawstring and the collapse of the annulus and the skirts of the annulus together with the deployment of the glove.
Figure 5:
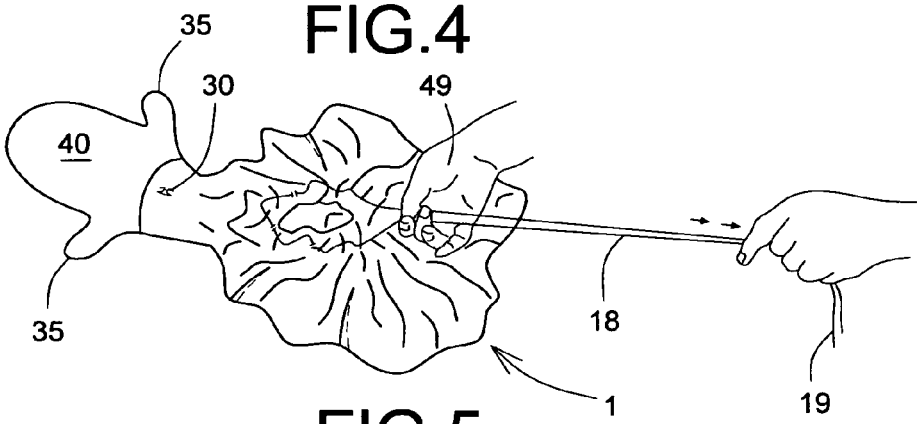
Figure 6:
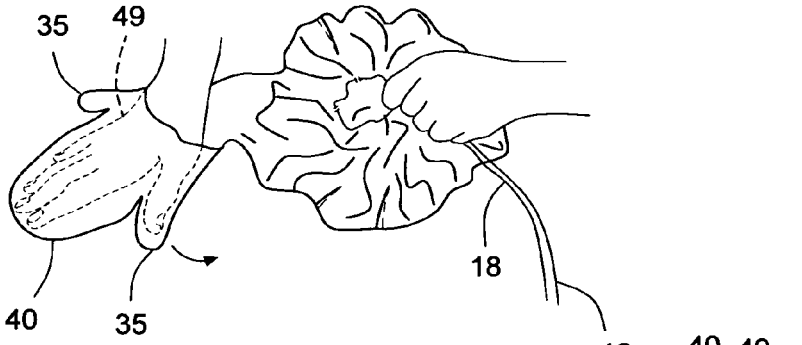
FIG. 6 shows insertion of a hand into the glove.
Figure 7:
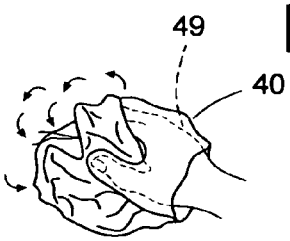
FIG. 7 shows the grasping of the collapsed annulus and skirts of the seat cover into a crumpled mass.
Figure 8:
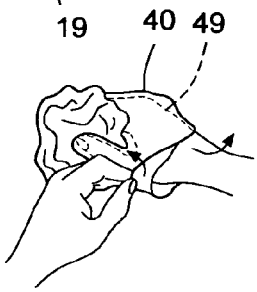
FIG. 8 depicts the inversion of the glove to encase the mass within the material of the glove.

Referring now to FIGS. 4, 5, 6, 7, and 8, when the individual has completed usage of the toilet 60, the drawstring 18 is pulled tight as shown in FIG. 4 which action initially collapses the annulus 2 and its skirts 4, 6 and simultaneously ruptures the loops 30, and 104 for cover 1', 104 formed by perforations 30, 104 to release the glove 40 from its rolled up status. The opened glove 40 is seen in FIG. 5 allowing access of hand 49 (FIG. 6). Further actuation of the drawstring 18 further collapses and crumples the glove 40 to a point at which the gloved hand 49 can grasp and encase the cover as in FIG. 7. The glove 40 is then inverted, i.e. reversed, using the other hand of the individual to enclose the crumpled used toilet seat cover 1, 1' therewithin, as in FIG. 8.

This encasement seeks to ensure that the skin of the individual does not come into contact with any part of the used seat cover 1, 1'. Accordingly the seat cover 1, 1' encased as aforesaid may be disposed of in a safe and sanitary fashion protecting not only the user but also others who subsequently visit the toilet.

It will be understood that the material from which the toilet seat cover is made may be any suitable kind, preferably pre-sanitized.

Further the material is preferably such as to allow folded stowage for ease of portability. Conveniently, a dispenser may be provided with a charge of seat covers for use during travel or indeed in the home or office.

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

What is claimed is:

1. A portable and disposable sanitary toilet seat cover comprising:

an annulus of a width corresponding to the width of a toilet seat and adapted to provide at least a covering for a top surface of the seat;

an inner skirt integral with and depending from the annulus on an inner boundary of the annulus;

an outer skirt integral with and depending from the annulus on an outer boundary of the annulus;

a glove integral with the annulus and extending outwardly from the outer boundary, the glove remaining integral with the annulus throughout the use of the cover; and a drawstring provided on the outer boundary of the annulus and adapted, when drawstring ends of the drawstring string are drawn away from the annulus, to inwardly collapse the annulus to sufficiently small dimension for fitting the annulus within a user's hand in the glove for disposal of the seat cover;

wherein the outer skirt is punctured adjacent the outer boundary with spaced apart pairs of drawstring retainer slits providing outer loops through which the drawstring is threaded, the drawstring ends being disposed at a front of the cover and the glove being disposed generally opposite thereto at a rear of the cover, the glove being connected at the rear of the annulus via a neck extending therefrom; and the neck having a pair of neck slits disposed thereon for forming a breakable neck loop through which the drawstring is threaded underneath the neck, wherein for an initial configuration for the cover, the glove is compactly rolled and the annulus and inner and outer skirts are fully extended for covering the seat with the drawstring maintaining the glove compactly rolled, the breakable glove loop being breakable by drawing of the strings away from the annulus to enable unfolding of the glove for placement of the hand therein when the annulus is collapsed by drawing of the drawstring ends away therefrom.

2. The toilet seat cover of claim 1, wherein the annulus and glove are made of a presanitized material.

3. The toilet seat cover of claim 1, wherein the inner skirt is pleated.

4. The toilet seat of claim 1, wherein the outer skirt is pleated.

5. The toilet seat cover of claim 1, wherein the annulus is made of a transparent material.

6. The toilet seat cover of claim 1, wherein the annulus is made of an opaque material.

7. The toilet seat cover of claim 1, wherein the glove is made of a transparent material.

8. The toilet seat cover of claim 1, wherein the glove is made of an opaque material.

9. The toilet seat of claim 1, wherein the inner skirt and the outer skirt are adapted, when the cover is placed on the seat, to cover a gap between the seat and a basin of the toilet upon which the seat rests.

10. The toilet seat of claim 1, wherein the glove is reversible as the glove is removed from the user's hand with another hand to enclose the toilet seat within the glove.

11. The toilet seat of claim 1, wherein the glove has two generally opposed thumb portions for receiving a thumb off the user, thereby enabling use of the glove with either a right hand or a left hand of the user.

12. The toilet seat of claim 3, wherein the outer skirt has a plurality of spaced apart substantially radial inner pleat slits cut inwardly from the inner boundary, the inner slits forming inner pleats in the inner skirt, the inner skirt being flared at the inner slits.

13. The toilet seat of claim 4, wherein the outer skirt has a plurality of spaced apart substantially radial outer pleat slits creased radially inwardly from the outer boundary, the outer slits forming outer pleats in the outer skirt, the outer skirt being flared at the outer slits.

14. The toilet seat of claim 4, wherein the outer skirt has a plurality of spaced apart substantially radial outer pleat slits cut radially inwardly from the outer boundary, the outer slits forming outer pleats in the outer skirt, the outer skirt being flared at the outer slits.

15. The toilet seat of claim 1, the outer skirt comprising first and second reliefs extending inwardly from the rear with the neck extending between the reliefs, the reliefs being adapted for accommodating, when the cover is placed on the seat, a conduit connecting a cistern of the toilet to the bowl.

* * * * *